US005986685A

United States Patent [19]

Aoki et al.

[11] Patent Number: 5,986,685

[45] Date of Patent: Nov. 16, 1999

[54] INTERMEDIATE TRANSFER TYPE THERMAL TRANSFER RECORDING METHOD

[75] Inventors: Masahiro Aoki; Kimihiro Yagi; Yukiko Tsujita, all of Osaka, Japan

[73] Assignee: Fujicopian Co., Ltd., Osaka, Japan

[21] Appl. No.: 08/958,439

[22] Filed: Oct. 27, 1997

[30] Foreign Application Priority Data

Oct. 28, 1996 [JP] Japan ..... 8-285060

[51] Int. Cl.[6] ..... B41J 2/325

[52] U.S. Cl. ..... 347/213; 347/212; 347/176

[58] Field of Search ..... 347/212, 213, 347/172, 174, 176; 400/120.02, 120.04

[56] References Cited

U.S. PATENT DOCUMENTS 4,738,555 4/1988 Nagashima ..... 347/176
5,168,289 12/1992 Katakabe et al. ..... 347/213
5,555,011 9/1996 Tang et al. ..... 347/212

FOREIGN PATENT DOCUMENTS 5-261951 10/1993 Japan .

*Primary Examiner*—Huan Tran
*Attorney, Agent, or Firm*—Fish & Neave

[57] ABSTRACT

An intermediate transfer type thermal transfer recording method comprising the steps of: forming first an image on an intermediate transfer medium by heating a melt-type thermal transfer recording medium with a heating head, and transferring the image formed on the intermediate transfer medium onto an image receptor pressed against the intermediate transfer medium, wherein an image of a heat-meltable colored ink is formed on an image receptor by said intermediate transfer type thermal transfer recording method and a transparent heat-meltable ink is then transferred on the image receptor to cover a region thereof including the image of the colored ink by said intermediate transfer type thermal transfer recording method. The method provides a lustrous image on a paper sheet and an image with high light transmittance on an OHP sheet.

4 Claims, 2 Drawing Sheets

INTERMEDIATE TRANSFER TYPE THERMAL TRANSFER RECORDING METHOD

BACKGROUND OF THE INVENTION

The present invention relates to an intermediate transfer type thermal transfer recording method.

The intermediate transfer type thermal transfer recording method is a method wherein a melt-type thermal transfer recording medium is used to form first an image on an intermediate transfer medium according to image signals, and the image obtained on the intermediate transfer medium is then transferred onto an image receptor.

The intermediate transfer type thermal transfer recording method is an image formation method wherein an intermediate transfer printer such as shown in FIG. 1 or FIG. 2 is used. In FIGS. 1 and 2, numeral 10 denotes a rotatable intermediate transfer drum and numeral 20 denotes a rotatable intermediate transfer belt. Numeral 11 denotes a recording part which is arranged so. that a thermal transfer recording medium 12 can be pressed against the intermediate transfer drum 10 or intermediate transfer belt 20 with a heating head 13. In recording, the recording medium 12 is moved in the direction indicated by an arrow as the intermediate transfer drum 10 or intermediate transfer belt 20 rotates. Numeral 14 denotes a transfer part which is arranged so that an image receptor 15 can be pressed against the intermediate transfer drum 10 or intermediate transfer belt 20 with a pressing roller 16. In transferring, the image receptor 15 is moved in the direction indicated by an arrow.

The thermal transfer recording medium 12 is heated with the heating head 13 so as to selectively soften or melt portions of the colored ink thereof, which are transferred onto the surface of the intermediate transfer drum 10 or intermediate transfer belt 20 as an intermediate transfer medium. While the intermediate transfer drum 10 or intermediate transfer belt 20 and the recording medium 12 are thus moved in the directions indicated by the arrows, respectively, the colored ink is transferred onto the intermediate transfer drum 10 or intermediate transfer belt 20, thereby forming an ink image 17 thereon. As the intermediate transfer drum 10 or intermediate transfer belt 20 rotates, the ink image 17 is moved to the transfer part 14, pressed against the image receptor 15 there, and transferred onto the image receptor 15 to form a final ink image 18 thereon.

According to such an intermediate transfer type thermal transfer recording method, the ink of the recording medium which is heated with the heating head 13 is transferred onto a smooth surface of the intermediate transfer drum 10 or intermediate transfer belt 20. Hence, the problem involved in a common thermal transfer method of the type that unclear transferred images are likely to be formed on an image receptor paper of which the surface is poor in smoothness-is overcome. Further, according to the intermediate transfer type thermal transfer recording method, ink images 17 on the intermediate transfer drum 10 or intermediate transfer belt 20 are transferred onto the image receptor 15 by pressing thereagainst under a large pressure with the pressing roller 16. Hence, the quality of the thus obtained images is not subject so much to the superficial conditions of the image receptor.

In the aforesaid intermediate transfer type thermal transfer recording medium, the surface of the intermediate transfer drum 10 or intermediate transfer belt 20 is formed of a material of releasing properties such as silicone resin or rubber, fluorine-containing resin or rubber, or the like to facilitate release of the ink image 17 therefrom. Further, when the ink image 17 formed on the intermediate transfer drum 10 or intermediate transfer belt 20 is transferred onto the image receptor 15, it is necessary that the ink is in a softened or molten state. Therefore, a means is usually adopted wherein a heater is contained in the intermediate transfer drum 10 intermediate transfer belt 20, or the pressing roller 16 to heat the ink into a softened or molten state.

However, the aforesaid intermediate transfer type thermal transfer recording method involves two problems: (1) when the image receptor is a paper sheet, a lusterless image is obtained on the paper sheet and (2) when the image receptor is an OHP sheet (transparent sheet for an overhead projector), the image obtained on the OHP sheet is low in light transmittance and therefore the projection of the imprinted OHP sheet by means of an OHP provides a dull projected image.

In view of the problems of the foregoing prior art, it is an object of the present invention to provide an intermediate transfer type thermal transfer recording method which is capable of providing a lustrous image on a paper sheet as an image receptor and providing an image with high light transmittance on an OHP sheet as an image receptor, resulting in a clear or vivid projected image.

This and other objects of the present invention will become apparent from the description hereinafter.

SUMMARY OF THE INVENTION

The present invention provides (1) an intermediate transfer type thermal transfer recording method comprising the steps of: forming first an image on an intermediate transfer medium by heating a melt-type thermal transfer recording medium with a heating head, and transferring the image formed on the intermediate transfer medium onto an image receptor pressed against the intermediate transfer medium, wherein an image of a heat-meltable colored ink is formed on an image receptor by said intermediate transfer type thermal transfer recording method and a transparent heat-meltable ink is then transferred on the image receptor to cover a region thereof including the image of the colored ink by said intermediate transfer type thermal transfer recording method.

The present invention further provides (2) the intermediate transfer type thermal transfer recording method of the above (1), wherein the intermediate transfer medium is heated to a temperature of 40° to 80° C. at the surface thereof, and the intermediate transfer medium and the pressing roller are in contact with each other under a pressure of 50 to 200 kg/30 cm, and the transparent heat-meltable ink has a softening point of 45° to 90° C. and a melt viscosity of 50 to $5\times10^5$ cp/100° C.

The present invention furthermore provides (3) the intermediate transfer type thermal transfer recording method of the above (1) or (2), wherein the transparent heat-meltable ink is transferred in substantially the same region as the region of the image of the colored ink transferred previously on the image receptor.

Moreover, the present invention provides (4) the intermediate transfer thermal transfer recording method of any of the above (1) to (3), wherein if the image receptor is an OHP sheet, and the image of the colored ink is formed on the OHP sheet by using one or more of yellow, magenta and cyan inks as the heat-meltable colored ink, then the yellow, magenta and cyan inks are inks each capable of forming a region of single color image having a maximum transmittance of not less than 50% in the visible region, provided that the region of the single color image is formed by transferring each ink onto the OHP sheet to form an ink image of single color thereon and transferring the transparent heat-meltable ink onto the ink image of single color.

In the present invention, the terms "melt-type" in the melt-type thermal transfer recording medium or "heat-meltable" in the heat-meltable vehicle is a concept including not only wherein the vehicle is changed from a solid state to a molten state but also wherein the vehicle is changed from a solid state to a softened state without reaching a molten state.

DETAILED DESCRIPTION

Figure 1:
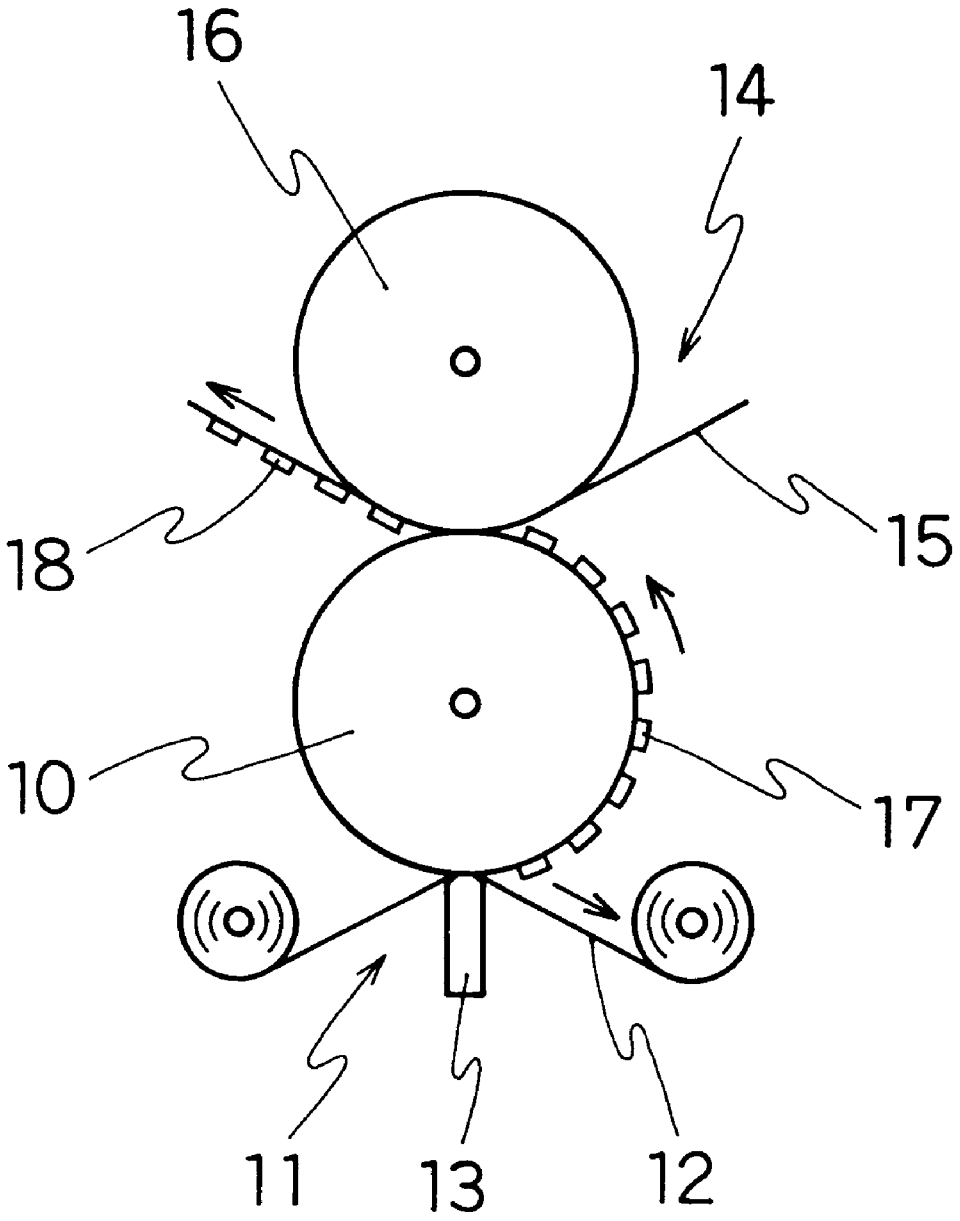
FIG. 1 is a schematic view showing an example of the intermediate transfer printer as used in the present invention.

In the thermal transfer recording method of the present invention, an image of a heat-meltable colored ink is first formed on an image receptor by the intermediate transfer method and an image of a transparent heat-meltable ink is then formed on the image of the colored ink by the intermediate transfer method.

By virtue of such a constitution, an image formed on a paper sheet as an image receptor is reduced in diffused reflection of the surface thereof to improve the luster of the image. Further, an image formed on an OHP sheet as an image receptor is reduced in diffused reflection of the surface thereof to improve the light transmittance of the image and when the image is projected by means of an OHP, a projected image of vivid or clear color is obtained. Furthermore, smearing of the image does not occur in both cases.

In the present invention, intermediate transfer printers, manners and conditions of operating the printers, thermal transfer recording media and the like which are used in the conventional intermediate transfer method can be adopted without any particular limitation except that an image of a heat-meltable colored ink is first formed on an image receptor by the intermediate transfer method and a transparent heat-meltable ink is transferred onto the image receptor to cover a region thereof including the image of the colored ink by the intermediate transfer method.

In the intermediate transfer printer, usually, the releasing surface of the intermediate transfer medium is heated to a temperature of 40° to 80° C. to enable the transfer of an image formed on the intermediate transfer medium to an image receptor. Further, the contact pressure between the intermediate transfer medium and the pressing roller is usually set to a value of 50 to 200 kg/30 cm (line pressure provided that the length of the intermediate transfer medium in the crosswise direction is 30 cm, hereinafter the same) to facilitate the transfer of an image formed on the intermediate transfer medium to an image receptor.

The heat-meltable colored ink useful in the present invention is a colored ink comprising a coloring agent and a heat-meltable vehicle (comprising a wax and/or a thermoplastic resin). The heat-meltable colored ink may be further incorporated with an additive such as a dispersing agent, or the like.

Examples of specific waxes include natural waxes such as lanolin, carnauba wax, candelilla wax, montan wax and ceresine wax; petroleum waxes such as paraffin wax and microcrystalline wax; synthetic waxes such as oxidized wax, ester wax, low molecular weight polyethylene wax, Fischer-Tropsch wax, α-olefin-maleic anhydride copolymer wax and synthetic petroleum wax. These waxes can be used either alone or in combination.

Examples of specific thermoplastic resins (inclusive of elastomers) include ethylene copolymers such as ethylene-vinyl acetate copolymer, ethylene-vinyl butyrate copolymer, ethylene-(meth)acrylic acid copolymer, ethylene-alkyl (meth)acrylate copolymer wherein examples of the alkyl group are those having 1 to 16 carbon atoms, such as methyl, ethyl, propyl, butyl, hexyl, heptyl, octyl, 2-ethylhexyl, nonyl, dodecyl and hexadecyl, ethylene-acrylonitrile copolymer, ethylene-acrylamide copolymer, ethylene-N-methylolacrylamide copolymer and ethylene-styrene copolymer; poly(meth)acrylic acid esters such as polylauryl methacrylate and polyhexyl acrylate; vinyl chloride polymer and copolymers such as polyvinyl chloride, vinyl chloride-vinyl acetate copolymer and vinyl chloride-vinyl alcohol copolymer; polyesters, polyamides, epoxy resins, cellulose resins, natural rubber, styrene- butadine copolymer, isoprene polymer and chloroprene polymer; petroleum resins, rosin resins, terpene resins and cumarone-indene resins. These resins can be used either alone or in combination.

Usable as the coloring agent in the colored ink layer are carbon black and other various organic and inorganic pigments. Examples of such organic and inorganic pigments include azo pigments (such as insoluble azo pigments, azo lake pigments and condensed azo pigments), phthalocyanine pigments, nitro pigments, nitroso pigments, anthraquinonoid pigments, nigrosine pigments, quinacridone pigments, perylene pigments, isoindolinone pigments, dioxazine pigments and titanium white. Such pigments may be used in combination with dyes.

In the case of forming multi-color or full-color images by utilizing subtractive color mixture, there are used yellow pigments, magenta pigments and cyan pigments, and as required, black pigments. These pigments for yellow, magenta and cyan are preferably transparent ones. Pigments for balck are usually opaque ones.

Examples of specific transparent pigments for yellow include organic pigments such as Naphthol Yellow S, Hansa Yellow 5G, Hansa Yellow 3G, Hansa Yellow G, Hansa Yellow GR, Hansa Yellow A, Hansa Yellow RN, Hansa Yellow R, Benzidine Yellow, Benzidine Yellow G, Benzidine Yellow GR, Permanent Yellow NCG, Quinoline Yellow Lake and Disazo Yellow. These pigments may be used either alone or in combination.

Examples of specific transparent pigments for magenta include organic pigments such as Permanent Red 4R, Brilliant Fast Scarlet, Brilliant Carmine BS, Permanent Carmine FB, Lithol Red, Permanent Red F5R, Brilliant Carmine 6B, Pigment Scarlet 3B, Rhodamine Lake B, Rhodamine Lake Y, Arizalin Lake and Quinacridone Red. These pigments may be used either alone or in combination.

Examples of specific transparent pigments for cyan include organic pigments such as Victoria Blue Lake, metal-free Phthalocyanine Blue, Phthalocyanine Blue and Fast Sky Blue. These pigments may be used either alone or in combination.

The term "transparent pigment" herein refers to a pigment which gives a transparently colored ink when dispersed in a transparent vehicle.

Examples of pigments for black include inorganic pigments such as carbon black, and organic pigments such as Aniline Black. These pigments may be used either alone or in combination.

In the case that the surface temperature of the intermediate transfer medium is from 40° to 80° C. and the contact pressure between the intermediate transfer medium and the pressing roller is from 50 to 200 kg/30 cm, as described above, a colored ink having a softening point of 55° to 75° C. and a melt viscosity of 50 to 400 cp/100° C. is preferably used to achieve favorable formation of an image of the colored ink on the intermediate transfer medium and favorable transfer of the image on the intermediate transfer medium to an image receptor.

The coating amount (on a solid basis, hereinafter the same) of the colored layer is preferably from 0.5 to 3.0 g/m$^2$.

The transparent heat-meltable ink usable in the present invention is a substantially colorless transparent one which comprises a heat-meltable vehicle (comprising a wax and/or a thermoplastic resin) and contains substantially no coloring agent.

Those exemplified for the colored ink can be used as the wax and thermoplastic resin which are the components of the heat-meltable vehicle for the transparent heat-meltable ink.

In the case that the surface temperature of the intermediate transfer medium is from 40° to 80° C. and the contact pressure between the intermediate transfer medium and the pressing roller is from 50 to 200 kg/30 cm, as described above, there is preferably used a transparent ink having a softening point of 45° to 90° C., especially 65° to 80° C. and a melt viscosity of 50 to 5×10$^5$ cp/100° C., especially 100 to 10×10$^3$ cp/100° C. When the softening point of the transparent heat-meltable ink is lower than the above range, the transparent ink is excessively softened on the intermediate transfer medium and hardly forms a uniform transparent ink layer when transferred onto the image of the colored ink on the image receptor. When the softening point of the transparent ink is higher than the above range, the transfer sensitivity at the time when the transparent ink is transferred onto the intermediate transfer medium is low. When the melt viscosity of the transparent heat-meltable ink is lower than the above range, the ink hardly forms a uniform transparent ink layer when transferred onto the image of the colored ink on the image receptor for the same reason as mentioned above. When the melt viscosity of the transparent ink is higher than the above range, the transfer sensitivity at the time when the transparent ink is transferred onto the intermediate transfer medium is low.

The coating amount of the transparent heat-meltable ink is preferably from 1.0 to 8.0 g/m$^2$. When the coating amount is smaller than the above range, the desired effects are hardly achieved. When the coating amount is larger than the above range, it is difficult to form a transparent ink layer on the image of the colored ink due to its low transfer sensitivity.

As the foundation for supporting the aforesaid colored ink or transparent ink, polyester films such as polyethylene terephthalate film, polybutylene terephthalate film, polyethylene naphthalate film and polyarylate film, polycarbonate film, polyamide film, aramid film, polyether sulfone film, polysulfone film, polyphenylene sulfide film, polyether ether ketone film, polyether imide film, modified polyphenylene ether film and polyacetal film, and other various plastic films commonly used for the foundation of ink ribbons of this type can be used. Thin paper sheets of high density such as condenser paper can also be used. The thickness of the foundation is usually from about 1 to about 10 $\mu$m. From the viewpoint of reducing heat spreading to increase the resolution of images, the thickness of the foundation is preferably from 1 to 6 $\mu$m .

A conventionally known stick-preventive layer is preferably provided on the back side (the side adapted to come into slide contact with the heating head) of the foundation. Examples of the materials for the stick-preventive layer include various heat-resistant resins such as silicone resins, fluorine-containing resins and nitrocellulose resins, and other resins modified with these heat-resistant resins, such as silicone-modified urethane resins and silicone-modified acrylic resins, and mixtures of the foregoing heat-resistant resins and lubricating agent.

The melt-type thermal transfer recording medium used for forming a colored ink image in the present invention includes a thermal transfer recording medium for forming an image of single color (monochromatic image) and a color thermal transfer recording medium for forming a multi-color or full-color image (polychromatic image) by utilizing subtractive color mixture.

The thermal transfer recording medium for forming single color image is one wherein a heat-meltable colored ink layer of single color is disposed on a foundation (hereinafter referred to as "thermal transfer recording medium A"). The color of the heat-meltable colored ink is black, red, blue, green, yellow, magenta, cyan or the like.

An embodiment of the color thermal transfer recording medium for forming a multi-color or full-color image is one wherein a yellow heat-meltable ink layer, a magenta heat-meltable ink layer and a cyan heat-meltable ink layer and optionally a black heat-meltable ink layer are disposed in a side-by-side relation on a single foundation. The manner of arrangement of such color ink layers includes various embodiments and is arbitrarily selected depending upon the type of printer used.

For example, there is exemplified an example wherein a yellow heat-meltable ink layer, a magenta heat-meltable ink layer and a cyan heat-meltable ink layer and optionally a black heat-meltable ink layer, each of which preferably has a given constant size, are repeatedly arranged in a side-by-side relation on a foundation in a repeating unit wherein the yellow, magenta, cyan ink layers and optionally the black ink layer are arranged in a predetermined order (hereinafter referred to as "thermal transfer recording medium B"). The order of arrangement of the respective color ink layers in the repeating unit can be arbitrarily determined in consideration of the transfer order of the respective color ink layers.

Another embodiment of the thermal transfer recording medium for forming a multi-color or full-color image is a set of thermal transfer recording media comprising a first thermal transfer recording medium having a yellow heat-meltable ink layer on a first foundation, a second thermal transfer recording medium having a magenta heat-meltable ink layer on a second foundation, and a third thermal transfer recording medium having a cyan heat-meltable ink layer on a third foundation, and optionally a fourth thermal transfer recording medium having a black heat-meltable ink layer on a fourth foundation (hereinafter referred to as "thermal transfer recording medium C").

An embodiment of the melt-type thermal transfer recording medium for forming a transparent ink image in accordance with the present invention is one wherein the aforesaid transparent heat-meltable ink layer is disposed on a foundation (hereinafter referred to as "thermal transfer recording medium D").

In the present invention, the colored ink and the transparent ink may be disposed in a side-by-side relation on a single foundation. For example, one can use the above-mentioned thermal transfer recording medium for forming single color images modified such that a colored ink layer and a transparent ink layer are alternately repeatedly disposed in a side-by-side relation on a foundation in the longitudinal direction thereof (hereinafter referred to as "thermal transfer recording medium E"). Further, one can use the above-mentioned color thermal transfer recording medium B modified such that a transparent ink layer is further included in the repeating unit comprising the yellow, magenta and cyan ink layers and optionally the black ink layer (hereinafter referred to as "thermal transfer recording medium F").

The thermal transfer recording method of the present invention will be explained using the intermediate transfer printer illustrated in FIG. 1. Of course, the present method can be practiced in the same manner using the intermediate transfer printer illustrated in FIG. 2.

First the formation of single color image using the thermal transfer recording media A and D will be explained. The formation of an image on the intermediate transfer drum 10 is performed by selectively heating the thermal transfer recording medium A 12 according to image signals with the heating head 13 to soften or melt portions of the colored ink layer, which are transferred onto the surface of the intermediate transfer drum 10. While the intermediate transfer drum 10 and the thermal transfer recording medium A 12 are thus moved in the directions indicated by the arrows, respectively, portions of the colored ink layer are transferred onto the intermediate transfer drum 10, thereby forming an image 17 of the colored ink thereon. As the intermediate transfer drum 10 rotates, the image 17 of the colored ink is moved to the transfer part 14, pressed against an image receptor 15 to form a final image 18 of the colored ink thereon. Then, using the thermal transfer recording medium D, a region of the transparent ink is formed on the intermediate transfer drum 10 and the region of the transparent ink is transferred onto the image 18 of the colored ink on the image recetor 15 in the same manner as above.

When using the thermal transfer recording medium E, an image of the colored ink and a region of the transparent ink are also formed successively on an image receptor in the same manner as above except that the colored ink layer and the transparent ink layer on the same recording medium are used.

Figure 2:
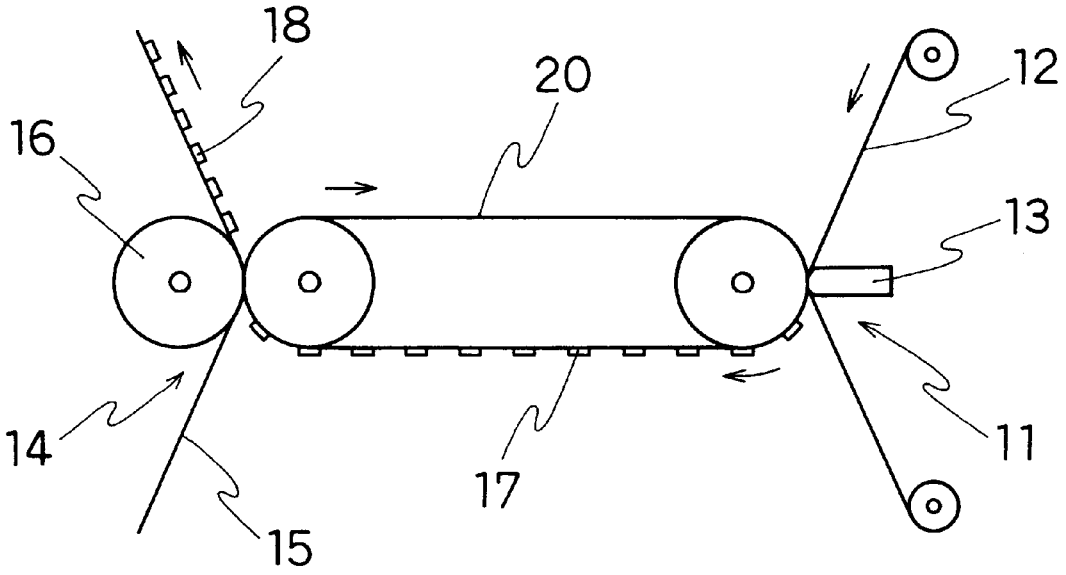
FIG. 2 is a schematic view showing another example of the intermediate transfer printer as used in the present invention.

The formation of a multi-color or full-color image using the thermal transfer recording medium B or C and the thermal transfer recording medium D will now be explained. When forming a color image using the thermal transfer recording medium C, one uses an intermediate transfer printer wherein the recording part 11 shown in FIG. 1 or FIG. 2 is one equipped with respective heating heads 13 for transfer of yellow ink, magenta ink and cyan ink, and optionally black ink.

The formation of a multi-color or full-color image using the thermal transfer recording media C and D can be performed by the following two methods:

Method I

Using, for example, a thermal transfer recording medium having a yellow ink layer among the three or four color ink layers, a yellow ink image is formed on the intermediate transfer drum 10 and the yellow ink image on the intermediate transfer drum 10 is transferred onto an image receptor 15 in the same manner as in the above-mentioned formation of a single color image. Then, the formation of a magenta ink image, and a cyan ink image, and optionally a black ink image are successively performed in the same manner as above. In that case, when one color signal among yellow, magenta and cyan color signals is absent, the formation of the corresponding color ink image is not performed. When a black image is formed by superimposition of the yellow, magenta and cyan ink layers, it is not required to use a thermal transfer recording medium having a black ink layer. The order of transfer of the respective color ink layers can be arbitrarily determined.

Thus, a multi-color or full-color ink image including regions wherein at least two of the yellow, magenta and cyan ink layers are superimposed to develop a color by virtue of subtractive color mixture is obtained on the image receptor 15.

Then, using the thermal transfer recording medium D, a region of the transparent ink is formed on the intermediate transfer drum 10 and the region of the transparent ink is transferred onto the color ink image on the image receptor 15 in the same manner as above.

Method II

Using, for example, a thermal transfer recording medium having a yellow ink layer among the three or four color ink layers, a yellow ink image is formed on the intermediate transfer drum 10 in the same manner as in the above-mentioned formation of a single color image. Then, using of a thermal transfer recording medium having a magenta ink layer and a thermal transfer recording medium having a cyan ink layer, and optionally a thermal transfer recording medium having a black ink layer, the formation of a magenta ink image and a cyan ink image, and optionally a black ink image are successively formed on the intermediate transfer drum 10. In that case, when one color signal among yellow, magenta and cyan color signals is absent, the formation of the corresponding color ink image is not performed. When a black image is formed by superimposition of the yellow, magenta and cyan ink layers, it is not required to form the black ink image using the black ink layer. The order of transfer of the respective color ink layers can be arbitrarily determined.

Thus, a multi-color or full-color ink image including regions wherein at least two of the yellow, magenta and cyan ink layers are superimposed to develop a color by virtue of subtractive color mixture is obtained on the intermediate transfer drum 10.

The multi-color or full-color ink image formed on the intermediate transfer drum 10 is transferred onto an image receptor 15 in the same manner as in the formation of a single color image.

Then, using of the thermal transfer recording medium D, a region of the transparent ink is formed on the intermediate transfer drum 10 and the region of the transparent ink is transferred onto the color ink image on the image receptor 15 in the same manner as above.

The formation of a multi-color or full-color image using the thermal transfer recording medium B and the thermal transfer recording medium D can be performed in the same manner as in Method I or Method II except that the respective color ink layers on the same recording medium are used to form a multi-color or full-color image on an image receptor 15.

Further, the formation of a multi-color or full-color image using the thermal transfer recording medium F can also be performed in the same manner as in Method I or Method II except that the respective color ink layers and the transparent ink layer on the same recording medium are used to form a multi-color or full-color ink image on an image receptor, and then to form a region of the transparent ink on the multi-color or full-color ink image.

In the method of the present invention, it is sufficient that the region where the transparent ink is transferred is substantially the same as or larger than the region of the colored ink image which has been previously transferred on the image receptor. It is particularly preferable to transfer the transparent ink in substantially the same region as the region of the colored ink image because the texture or touch of the region of the image receptor where the colored ink image is not formed is not injured.

As the image receptor useful in the method of the present invention various materials such as paper sheets, plastic films or sheets, fabrics and nonwoven fabrics are exemplified.

In particular, when an OHP sheet is used as the image receptor and the colored ink image (inclusive of single color image and multi-color or full-color image) is formed on the OHP sheet by using one or more of yellow, magenta and cyan inks as the heat-meltable colored ink, it is preferable to use yellow, magenta and cyan inks each capable of forming a region of single color image having a maximum transmittance of not less than 50% in the visible region, provided that the region of the single color image is formed by transferring each ink onto the OHP sheet to form an ink image of single color thereon and transferring the transparent heat-meltable ink onto the ink image of single color. The obtained OHP sheet with a color image gives a projected image of a vivid or clear color when projected by means of an OHP. Herein the transmittance value is a value obtained by subtracting the transmittance value of the foundation from the observed value (hereinafter the same).

The present invention will be more fully described by way of the following Examples. It is to be understood that the present invention is not limited to the Examples, and various changes and modifications may be made in the invention without departing from the spirit and scope thereof.

Production of thermal transfer recording media

Onto the front side of a 3.5 μm-thick polyethylene terephthalate film which was provided on the back side thereof with a heat-resistant stick-preventive layer were applied the colored inks of respective colors each having the formula shown in Table 1 by a hot-melt coating method to give a color thermal transfer recording medium wherein yellow, magenta and cyan ink layers were repeatedly disposed in a side-by-side relation on the foundation film in the longitudinal direction thereof.

TABLE 1

| | Yellow ink | Magenta ink | Cyan ink |
|---|---|---|---|
| Ink formula (% by weight) | | | |
| Paraffin wax | 60 | 60 | 60 |
| Candelilla wax | 10 | 10 | 10 |
| α-Olefin-maleic anhydride copolymer wax | 10 | 10 | 10 |
| Ethylene-vinyl acetate copolymer | 5 | 5 | 5 |
| Disazo Yellow | 15 | — | — |
| Brilliant Carmine 6B | — | 15 | — |
| Phthalocyanine Blue | — | — | 15 |
| Physical properties of ink layer | | | |
| Coating amount (g/m$^2$) | 2.0 | 2.0 | 2.0 |
| Softening point (° C.) | 72 | 72 | 72 |
| Melt viscosity (cps/100° C.) | 150 | 110 | 120 |

Onto the front side of a 3.5 μm -thick polyethylene terephthalate film which was provided on the back side thereof with a heat-resistant stick-preventive layer was applied the heat-meltable ink having the formula shown in Table 2 by a hot-melt coating method to give a thermal transfer recording medium having a transparent ink layer (hereinafter referred to as "transparent thermal transfer recording medium").

TABLE 2

| | Transparent ink | |
|---|---|---|
| | A | B |
| Ink formula (% by weight) | | |
| Ethylene-vinyl acetate copolymer | 10 | 17 |
| Candelilla wax | 45 | 30 |
| Carnauba wax | 18 | 38 |
| Alicyclic saturated hydrocarbon resin | 12 | 15 |
| Synthetic petroleum resin | 15 | — |
| Physical properties of ink layer | | |
| Coating amount (g/m$^2$) | 6.0 | 6.0 |
| Softening point (° C.) | 73 | 75 |
| Melt viscosity (cps/100° C.) | 180 | 250 |

Examples 1 and 2 and Comparative Example

With use of the thus obtained color thermal transfer recording medium, single color ink images of yellow, magenta and cyan were formed on an image receptor (Xerox 4024 paper sheet made by Xerox Corporation or OHP sheet made by Minnesota Mining and Manufacturing Company) by means of an intermediate transfer printer (test machine). The printer had substantially the same construction as illustarated in FIG. 1. The intermediate transfer drum used was one coated with a silicone rubber at its surface. The intermediate transfer drum was used under the condition of being heated to 55° C. at its surface. The contact pressure between the intermediate transfer drum and the pressing roller was set to a value of 100 kg/30 cm.

Then, using of the transparent thermal transfer recording medium, the transparent ink was solid-printed onto the respective color ink images formed on the image receptor by means of the aforesaid intermediate transfer printer. In the Comparative Example the transparent ink was not transferred onto the respective color ink images formed on the image receptor.

With respect to the respective color ink images formed on the paper sheet, Xerox 4024, the degree of luster was evaluated through the visual observation Further, with respect to the color images formed on the OHP sheet, the maximum transmittance of the yellow, magenta and cyan regions in the visual region (value measured at 650 nm for yellow, 650 nm for magenta and 500 nm for cyan) was measured by means of a spectrophotometer, MS-2020 made by Macbeth corp.

The results thereof are shown in Table 3.

TABLE 3

| | Transparent ink | Paper sheet (Xerox 4024) Luster | OHP sheet Transmittance (%) Yellow | Magenta | Cyan |
|---|---|---|---|---|---|
| Ex. 1 | A | Good | 65 | 66 | 65 |
| Ex. 2 | B | Good | 63 | 63 | 60 |
| Com. Ex. | None | None | 42 | 45 | 40 |

According to the intermediate transfer type thermal transfer recording method of the present invention, a lustrous image is provided on a paper sheet as an image receptor and an image with high light transmittance is provided on an OHP sheet as an image receptor, resulting in a clear or vivid projected image.

In addition to the materials and ingredients used in the Examples, other materials and ingredients can be used in the present invention as set forth in the specification to obtain substantially the same results.

What we claim is:

1. An intermediate transfer type thermal transfer recording method comprising the steps of:

(a) forming an image of heat-meltable colored ink on an intermediate transfer medium by heating a melt-type thermal transfer recording medium with a heating head, (b) transferring the image formed on the intermediate transfer medium onto an image receptor pressed against the intermediate transfer medium by means of a pressing roller, and (c) transferring a transparent heat-meltable ink containing substantially no coloring agent onto the image receptor by forming first a transparent heat-meltable ink layer on the intermediate transfer medium by heating the transparent heat-meltable ink with the heating head and transferring the layer formed on the intermediate transfer medium onto the image receptor to cover a region thereof including the ink image, wherein the image of the heat-meltable colored ink is formed on the image receptor by said intermediate transfer type thermal transfer recording method and the transparent heat-meltable ink is then transferred onto the image receptor to cover a region thereof including the image of the colored ink by said intermediate transfer type thermal transfer recording method.

2. The intermediate transfer type thermal transfer recording method of claim 1, wherein the intermediate transfer medium is heated to a temperature of 40° to 80° C. at the surface thereof, and the intermediate transfer medium and the pressing roller are in contact with each other under a pressure of 50 to 200 kg/30 cm, and the transparent heat-meltable ink h as a softening point of 45° to 90° C. and a melt viscosity of 50 to $5\times10^5$ cp/100° C.

3. The intermediate transfer type thermal transfer recording method of claim 1, wherein the transparent heat-meltable ink is transferred in substantially the same region as the region of the image of the colored ink transferred previously on the image receptor.

4. The intermediate transfer thermal transfer recording method of claim 1, wherein, if the image receptor is an OHP sheet, and the image of the colored ink is formed on the OHP sheet by using one or more of yellow, magenta and cyan inks as the heat-meltable colored ink, then the yellow, magenta and cyan inks are each capable of forming a region of single color image having a maximum transmittance of not less than 50% in the visible region, provided that the region of the single color image is formed by:

(1) transferring each ink onto the OHP sheet to form an ink image of single color thereon; and (2) transferring the transparent heat-meltable ink onto the ink image of single color.

* * * * *

UNITED STATES PATENT AND TRADEMARK OFFICE

CERTIFICATE OF CORRECTION

PATENT NO. : 5,986,685

DATED : November 16, 1999

INVENTOR(S) : Masahiro Aoki, et. al.

It is certified that error appears in the above-identified patent and that said Letters Patent is hereby corrected as shown below:

Column 1, line 20 delete "so." and substitute therefor -- so --.

Column 1, line 52 delete "the" and substitute therefor -- this --.

Column 1, line 55 delete "smoothness-is" and substitute therefor -- smoothness is --.

Column 2, line 8 after "10" insert a comma -- , --.

Column 2, line 61 after "transfer", first occurrence, insert -- type --.

Column 7, line 19 delete "image" and substitute therefor -- images --.

Column 7, line 39 delete "recetor" and substitute therefor -- receptor --.

Column 8, line 48 delete "of".

Column 10, line 36 delete "of".

Column 12, line 7 delete "h as" and substitute therefor -- has --.

Column 12, line 14 after "intermediate transfer" insert -- type --.

Signed and Sealed this

Twenty-sixth Day of December, 2000

*Attest:*

Q. TODD DICKINSON

*Attesting Officer*

*Director of Patents and Trademarks*